US007628027B2

(12) United States Patent
Shapiro

(10) Patent No.: US 7,628,027 B2
(45) Date of Patent: Dec. 8, 2009

(54) REFRIGERATION SYSTEM WITH MECHANICAL SUBCOOLING

(75) Inventor: Doron Shapiro, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 700 days.

(21) Appl. No.: 11/184,142

(22) Filed: Jul. 19, 2005

(65) Prior Publication Data

US 2007/0017240 A1 Jan. 25, 2007

(51) Int. Cl.
*F25B 1/00* (2006.01)
*F25B 49/00* (2006.01)

(52) U.S. Cl. ..... 62/228.1; 62/510; 62/513

(58) Field of Classification Search ..... 62/113, 62/175, 228.1, 228.3, 228.4, 510, 513
See application file for complete search history.

(56) References Cited

U.S. PATENT DOCUMENTS

| | | | | |
|---|---|---|---|---|
| 3,229,475 | A | | 1/1966 | Balk et al. |
| 3,230,732 | A | | 1/1966 | Rutishauser et al. |
| 3,937,600 | A | | 2/1976 | White |
| 4,580,414 | A | | 4/1986 | Engelhard |
| 4,594,858 | A | | 6/1986 | Shaw |
| 4,706,470 | A | | 11/1987 | Akazawa et al. |
| 4,750,871 | A | | 6/1988 | Curwen |
| 4,787,211 | A | | 11/1988 | Shaw |
| 4,885,914 | A | * | 12/1989 | Pearman ..... 62/129 |
| 4,949,554 | A | | 8/1990 | Branz et al. |
| 5,095,712 | A | | 3/1992 | Narreau |
| 5,600,961 | A | | 2/1997 | Whipple, III |
| 5,743,098 | A | | 4/1998 | Behr |
| 5,775,117 | A | | 7/1998 | Shaw |
| 5,779,455 | A | | 7/1998 | Steiger |
| 5,809,792 | A | | 9/1998 | Song |
| 5,947,693 | A | | 9/1999 | Yang |
| 5,980,211 | A | | 11/1999 | Tojo et al. |
| 6,082,132 | A | | 7/2000 | Numoto et al. |
| 6,084,320 | A | | 7/2000 | Morita et al. |

(Continued)

FOREIGN PATENT DOCUMENTS

DE 4127754 2/1993

(Continued)

OTHER PUBLICATIONS

Carlyle Compressor DIV., Carrier Corporation, Compound Cooling Compressor Application Guide, Apr. 1984, Lit No. 574-066, Syracuse, NY.

(Continued)

*Primary Examiner*—Marc E Norman
(74) *Attorney, Agent, or Firm*—Michael Best & Friedrich LLP

(57) ABSTRACT

A refrigeration system includes a primary compressor that receives refrigerant from an evaporator and delivers refrigerant to a condenser, a subcooling compressor that delivers refrigerant to the condenser, and a subcooler that receives refrigerant from the condenser. A first refrigerant flow path and a second refrigerant flow path pass through the subcooler. The first refrigerant flow path delivers a portion of the refrigerant to the evaporator, and the second refrigerant flow path delivers a remainder of the refrigerant to the subcooling compressor. The refrigeration system includes a controller operable to control operation of the subcooling compressor such that the refrigeration system operates at a point of highest efficiency.

29 Claims, 4 Drawing Sheets

U.S. PATENT DOCUMENTS

| | | | | |
|---|---|---|---|---|
| 6,092,999 | A | 7/2000 | Lilie et al. | |
| 6,105,378 | A | 8/2000 | Shaw | |
| 6,128,911 | A | 10/2000 | Mathews et al. | |
| 6,231,310 | B1 | 5/2001 | Tojo et al. | |
| 6,276,148 | B1 | 8/2001 | Shaw | |
| 6,286,326 | B1 | 9/2001 | Kopko | |
| 6,425,255 | B1 | 7/2002 | Hoffman | |
| 6,437,524 | B1 | 8/2002 | Dimanstein | |
| 6,474,087 | B1 | 11/2002 | Lifson | |
| 6,527,519 | B2 | 3/2003 | Hwang et al. | |
| 6,554,577 | B2 | 4/2003 | Park et al. | |
| 6,619,052 | B1 | 9/2003 | Nash, Jr. | |
| 6,623,246 | B2 | 9/2003 | Hwang et al. | |
| 6,623,255 | B2 | 9/2003 | Joong et al. | |
| 6,641,377 | B2 | 11/2003 | Tpyama et al. | |
| 6,663,351 | B2 | 12/2003 | Joo | |
| 6,820,434 | B1 | 11/2004 | Gutheim et al. | |
| 7,032,400 | B2 | 4/2006 | Roche et al. | |
| 2003/0010046 | A1 | 1/2003 | Freund et al. | |
| 2003/0213256 | A1 | 11/2003 | Ueda et al. | |
| 2004/0123605 | A1 | 7/2004 | Pruitt et al. | |
| 2004/0163403 | A1 | 8/2004 | Monfarad | |
| 2005/0098162 | A1 | 5/2005 | Bryant | |
| 2006/0171825 | A1 | 8/2006 | Choi et al. | |
| 2006/0201188 | A1* | 9/2006 | Kopko | 62/333 |
| 2006/0225445 | A1* | 10/2006 | Lifson et al. | 62/175 |

FOREIGN PATENT DOCUMENTS

| | | |
|---|---|---|
| DE | 20307327 U | 9/2004 |
| EP | 0106414 | 4/1984 |
| EP | 0161429 | 11/1985 |
| EP | 0935106 | 8/1999 |
| EP | 1347251 | 9/2003 |
| JP | 54042058 | 4/1979 |
| JP | 03267592 | 11/1991 |
| JP | 10197082 | 7/1998 |
| JP | 11337198 | 12/1999 |
| JP | 2004278824 | 10/2004 |
| WO | 0016482 | 3/2000 |
| WO | 0079671 | 12/2000 |

OTHER PUBLICATIONS

Huff, H. J. et al., "Options for a Two-Stage Transcriptional Carbon Dioxide Cycle," IIR Gustav Lorentzen Conference on Natural Working Fluids, Joint Conference of the International Institute of Refrigeration Section B and E, XX, XX, Sep. 17, 2002, pp. 158-164, XP001176579.

Unger, Reuven Z., Linear Compressors for Clean and Specialty Gases, 1998 International Compressor Engineering Conference, Purdue University, Jul. 14-17, 1998.

European Search Report dated Jan. 18, 2008.

* cited by examiner

REFRIGERATION SYSTEM WITH MECHANICAL SUBCOOLING

BACKGROUND

The present invention relates to a refrigeration system including multiple compressors, and more particularly to mechanical subcooling of the refrigeration system to maximize operating efficiency.

In refrigeration systems, such as those used in cooling display cases of refrigeration merchandisers, it is necessary to maintain a constant temperature in the display cases to ensure the quality and condition of the stored commodity. Many factors demand varying the cooling loads on evaporators cooling the display cases. Therefore, selective operation of the compressor of the refrigeration system at different cooling capacities corresponds to the cooling demand of the evaporators. In refrigeration systems utilizing existing scroll and screw compressors, an economizer cycle is used to increase the refrigeration capacity and improve efficiency of the refrigeration system. In the economizer cycle of existing scroll and screw compressors, gas pockets in the compressor create a second "piston" as mechanical elements of the compressor proceed through the compression process.

Existing refrigeration systems with parallel compressors and mechanical subcooling do not operate most efficiently. Typically, such systems do not permit the intermediate pressure (i.e., the evaporating pressure of the subcooling compressor or compressors) and/or temperature to be adjusted to maximize efficiency of the refrigeration system.

SUMMARY

In one embodiment, the invention provides a refrigeration system including a primary compressor, a subcooling compressor, and a subcooler. The primary compressor receives refrigerant from an evaporator and delivers refrigerant to a condenser, the subcooling compressor delivers refrigerant to the condenser, and the subcooler receives refrigerant from the condenser. A first refrigerant flow path and a second refrigerant flow path pass through the subcooler. The first refrigerant flow path delivers a portion of the refrigerant to the evaporator, and the second refrigerant flow path delivers a remainder of the refrigerant to the subcooling compressor. The refrigeration system also includes a controller operable to control operation of the subcooling compressor such that the refrigeration system operates at a point of highest efficiency.

In another embodiment, the invention provides a refrigeration system including a primary compressor that receives refrigerant from an evaporator and delivers refrigerant to a condenser, a subcooling compressor that delivers refrigerant to the condenser, and a subcooler that receives refrigerant from the condenser. The subcooler includes a first refrigerant flow path that delivers a portion of the refrigerant to the evaporator and a second refrigerant flow path that delivers a remainder of the refrigerant to the subcooling compressor. The refrigeration system also includes a controller operable to control operation of the subcooling compressor. A first sensor measures a first operating condition of the refrigeration system and a second sensor measures a second operating condition of the refrigeration system. The first sensor is coupled to the controller and the first operating condition corresponds to a primary evaporating temperature of the refrigeration system, while the second sensor is coupled to the controller and the second operating condition corresponds to a condensing temperature of the refrigeration system. Based upon the first operating condition measured by the first sensor and the second operating condition measured by the second sensor, the controller controls operation of the subcooling compressor to obtain highest efficiency operation of the refrigeration system.

In yet another embodiment, the invention provides a control system for managing operation of a subcooling compressor in a refrigeration system. The control system includes a controller coupled to the subcooling compressor and operable to control operation of the subcooling compressor. A first sensor measures a first operating condition of the refrigeration system and a second sensor measures a second operating condition of the refrigeration system. The first sensor is coupled to the controller and the first operating condition corresponds to a primary evaporating temperature of the refrigeration system. The second sensor is coupled to the controller and the second operating condition corresponds to a condensing temperature of the refrigeration system. The controller controls operation of the subcooling compressor to obtain highest efficiency operation of the refrigeration system based upon the first operating condition and the second operating condition.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

The present invention described with respect to FIGS. 1-5 relates to a refrigeration system 10 with mechanical subcooling that includes a primary compressor 14 and a subcooling compressor 18. The refrigeration system 10 also includes a control system for operating the subcooling compressor 18. The control system controls operation of the subcooling compressor 18 to maintain a subcooler evaporating temperature at a point of highest efficiency for the refrigeration system 10.

Figure 1:
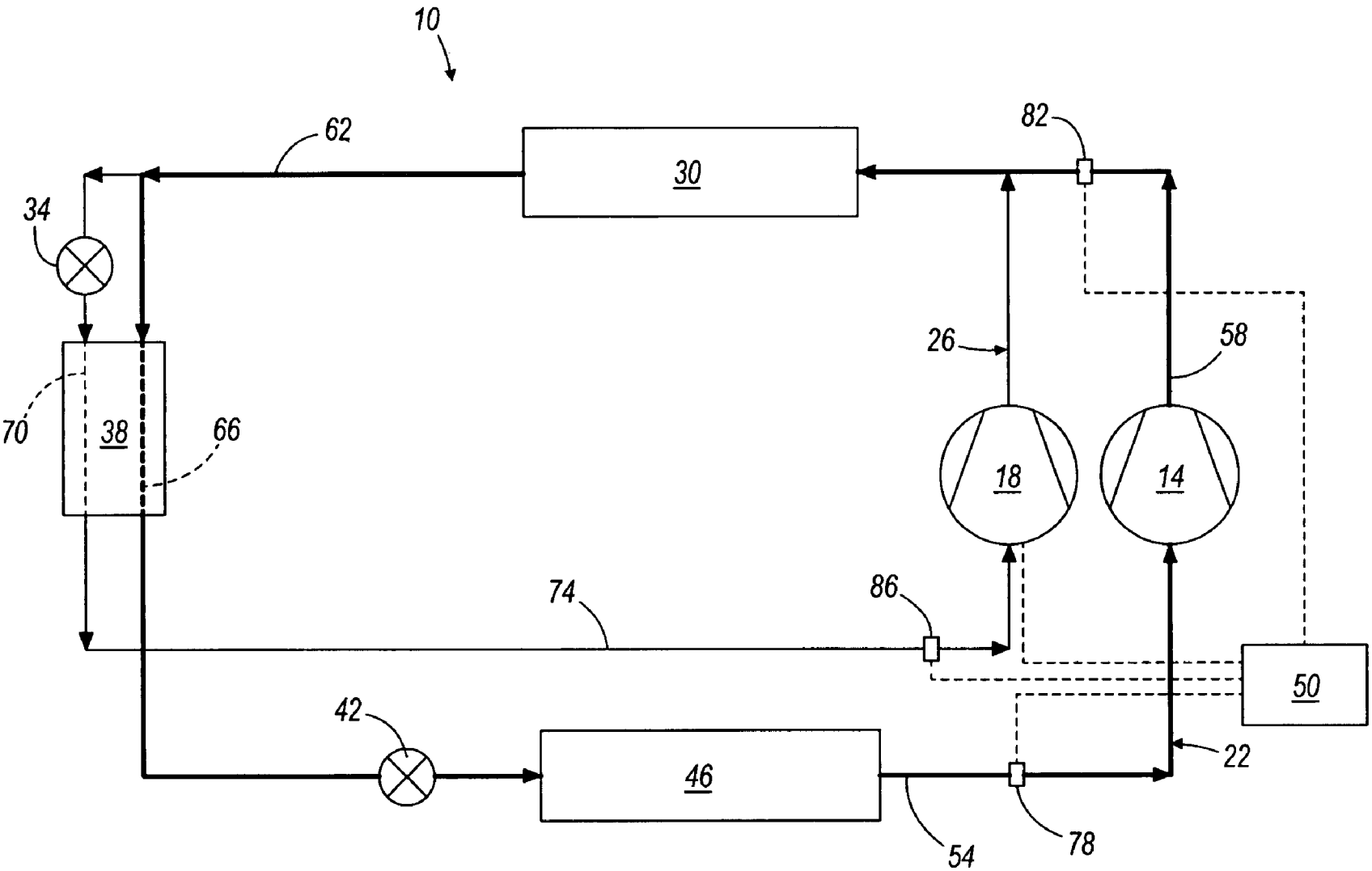
FIG. 1 is a schematic diagram of a refrigeration system, including a primary compressor and a subcooling compressor, embodying the invention.

FIG. 1 is a schematic diagram of the refrigeration system 10 including the primary compressor 14 and the subcooling compressor 18. In FIG. 1 the refrigeration system 10 is shown with a first refrigerant flow path 22 (shown as a bold, solid line in FIG. 1), in which refrigerant flows to the primary compressor 14, and a second refrigerant flow path 26 (shown as a solid line in FIG. 1), in which refrigerant flows to the subcooling compressor 18. In the illustrated embodiment, components of the refrigeration system 10 include the primary compressor 14, the subcooling compressor 18, a condenser 30, a first expansion device 34 (typically referred to as an expansion valve), a liquid subcooler 38 (or economizer), a second expansion device 42, and an evaporator 46, all of which are in fluid communication. In a further embodiment, the refrigeration system 10 includes other components, such as a receiver, a filter, etc.

The refrigeration system 10 includes a controller 50 for controlling operation of the subcooling compressor 18. The controller 50 is operable to vary running speed of the subcooling compressor 18, and control operation of the primary compressor 14. In a further embodiment, one controller operates the subcooling compressor 18 and another controller operates the primary compressor 14.

In the illustrated refrigeration system 10, multiple compressors (i.e., the primary and subcooling compressors 14, 18) compress at least a portion of the refrigerant within the refrigeration system 10 to provide mechanical subcooling, whereby the refrigerant discharge is in parallel by the primary compressor 14 and the subcooling compressor 18. The subcooling is performed by separate compressors. In this process, compressing the refrigerant achieves the same amount of cooling with the refrigeration system 10 as conventional single compressor systems, but requires less energy and is therefore more efficient and less costly.

In operation, the primary compressor 14 receives cool refrigerant from an evaporator line 54 fed by the evaporator 46 and compresses the refrigerant, which increases the temperature and pressure of the refrigerant. The compressed refrigerant is discharged from the primary compressor 14 as a high-temperature, high-pressure gas to a discharge line 58 that feeds the condenser 30. High-temperature, high-pressure refrigerant from the subcooling compressor 18 is mixed with the discharged gas from the primary compressor 14 in the discharge line 58. Mixing the refrigerant from the primary compressor 14 with the refrigerant from the subcooling compressor 18 eliminates the need for a second condenser and lowers the temperature of the refrigerant entering the condenser 30. The mixed refrigerant enters the condenser 30 from the discharge line 58.

The condenser 30 changes the refrigerant from a high-temperature, high-pressure gas to a warm-temperature, high-pressure liquid. Air and/or liquid, such as water, are commonly used to help cause this transformation. The high-pressure liquid refrigerant then travels to the subcooler 38 through a refrigerant line 62. A portion of the refrigerant is directed to the first refrigerant flow path 22 through a first side 66 of the subcooler 38 and the remaining refrigerant is directed to the second refrigerant flow path 26 through a second side 70 of the subcooler 38. In one embodiment, a control valve is used to divert refrigerant from the refrigerant line 62 to the second refrigerant flow path 26.

The warm-temperature, high-pressure liquid refrigerant passes through a heat exchanger (not shown) on the first side 66 of the subcooler 38 and is cooled further to a cool-temperature, high-pressure liquid refrigerant. This cool-temperature, high pressure liquid is then fed to the main evaporator's expansion valve 42. Warm-temperature, high-pressure liquid refrigerant from the second refrigerant flow path 26 passes through the first expansion valve 34, which creates a pressure drop and a temperature drop. Low-temperature, medium-pressure refrigerant exits the first expansion valve 34 and passes through the second side 70 of the subcooler 38, which cools the refrigerant passing through the first side 66 of the subcooler 38. Low-temperature, medium-pressure refrigerant exits the second side 70 of the subcooler 38 and is fed to the subcooling compressor 18.

In FIG. 1, refrigerant flows through the first and second sides 66, 70 of the subcooler 38 in parallel, i.e., in the same direction of flow, typically referred to as parallel flow. It should be readily apparent to those skilled in the art that refrigerant may counter-flow through the first and second sides 66, 70 of the subcooler 38, i.e., in opposite directions. Although not shown in FIG. 1, in further embodiments, the refrigeration system 10 includes a receiver positioned prior to the subcooler 38 for storing refrigerant before the refrigerant is provided to the subcooler 38. In yet another embodiment, the refrigerant line 62 splits into the first and second refrigerant flow paths after the refrigerant passes through the first side 66 of the subcooler 38 (i.e., the expansion valve 34 is fed cool-temperature, high-pressure liquid from the outlet of the first side 66 of the subcooler 38).

The refrigerant from the first side 66 of the subcooler 38 passes through the second expansion valve 42, which creates a pressure drop and a temperature drop in the refrigerant. Cold-temperature, low-pressure refrigerant enters the evaporator 46 and cools commodities stored in environmental spaces (not shown). After leaving the evaporator 46, the cool refrigerant is fed to the primary compressor 14 through the evaporator line 54 to be pressurized again and the cycle repeats.

The cool-temperature, medium-pressure refrigerant from the second side 70 of the subcooler 38 enters a subcooler line 74 that delivers the refrigerant to the subcooling compressor 18. The subcooling compressor 18 pressurizes the refrigerant to a high-temperature, high-pressure gas.

In the illustrated embodiment, the expansion valves 34, 42 are thermal expansion valves controlled by temperature and pressure within the refrigeration system 10. The first expansion valve 34 is controlled by pressure and temperature at the outlet of the second side 70 of the subcooler 38, i.e., the temperature and pressure of the subcooler line 74 that feeds the subcooling compressor 18. The second expansion valve 42 is controlled by temperature and pressure at the outlet of the evaporator 46, i.e., the temperature and pressure at the evaporator line 54 that feeds the primary compressor 14. In a further embodiment, either or both of the expansion valves 34, 42 are an electronic valve controlled by the controller 50 (or separate, independent controllers) based upon measured temperature and/or pressure at the outlet of the respective subcooler or evaporator.

The multiple compressor refrigeration system 10 utilizes mechanical subcooling of the refrigerant to achieve energy efficient cooling of refrigerant for delivery to the evaporator 46. In mechanical subcooling, the liquid refrigerant of a lower temperature system is cooled by evaporating the refrigerant of a higher temperature system. Colder refrigerant means more cooling per pound of refrigerant delivered to the evaporator 46, or shorter compressor run-times, because less refrigerant is needed, which decreases energy use.

The primary compressor 14 is used over the full lift of the refrigeration system 10. For example, the primary compressor 14 operates from a minimum primary evaporating temperature of −25° F. to a maximum condensing temperature of 110° F. At least one subcooling compressor 18 is used to cool liquid refrigerant that is eventually fed to the evaporator 46. As shown in FIG. 1, liquid refrigerant is cooled in the subcooler 38. Gas from the subcooler 38 is delivered to the subcooling compressor 18, via the second refrigerant flow path 26, while cool liquid refrigerant from the subcooler 38 is delivered to the evaporator 46, via the first refrigerant flow path 22.

Figure 2:
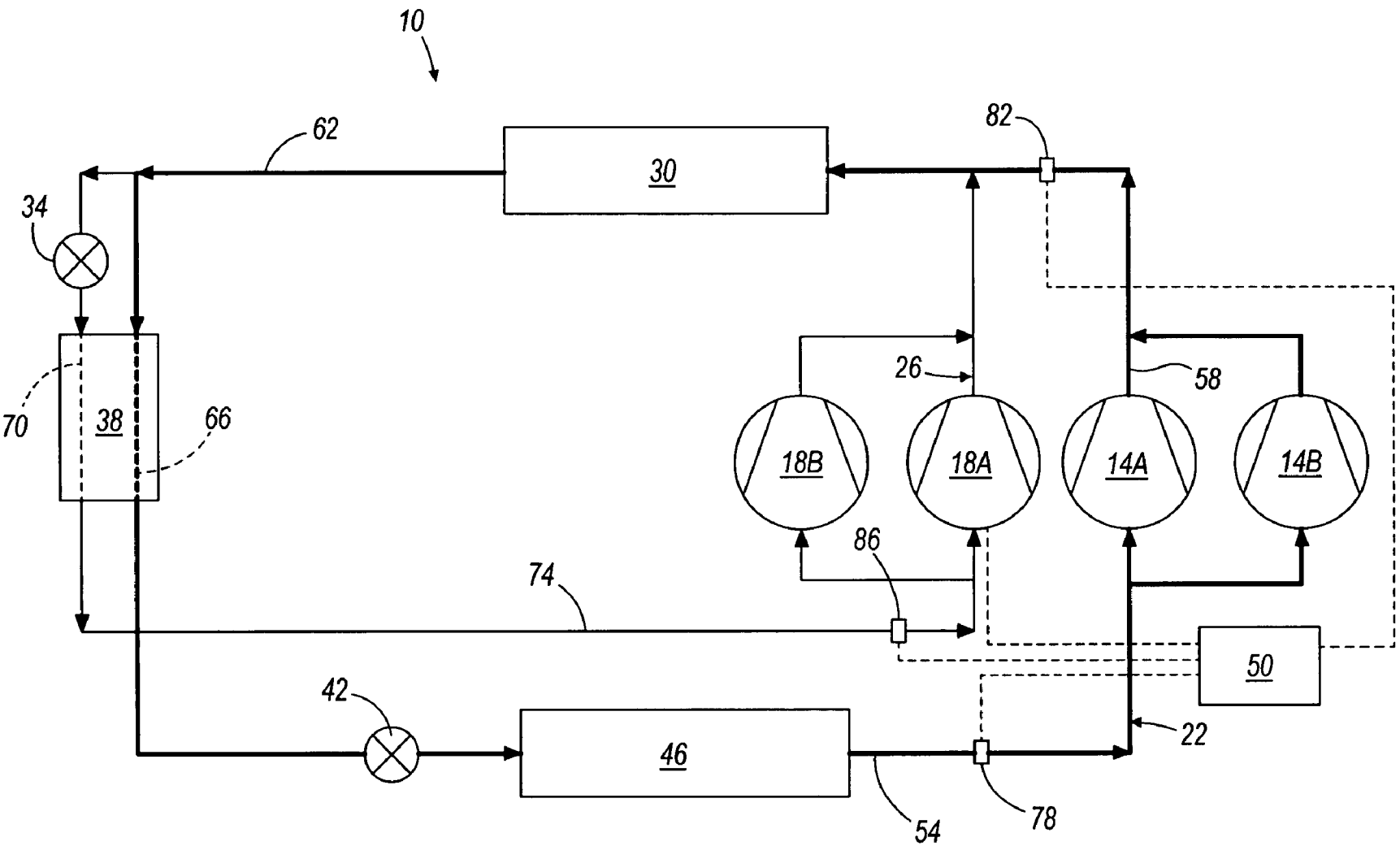
FIG. 2 is a schematic diagram of another embodiment of the refrigeration system, including two primary compressors and two subcooling compressors.

In a further embodiment, the refrigeration system 10 includes more than one primary compressor 14 and/or includes more than one subcooling compressor 18. FIG. 2 illustrates another embodiment of the refrigeration system that includes two primary compressors 14A, 14B arranged in a parallel configuration, and two subcooling compressors 18A, 18B arranged in a parallel configuration.

In a preferred embodiment, the primary compressor 14 and the subcooling compressor 18 are reciprocating compressors, however, the primary and subcooling compressors do not need to be of the same type. Those skilled in the art will recognize that other types of compressors may be used in the refrigeration system 10, including, but not limited to screw compressors and scroll compressors.

To maximize operating efficiency of the refrigeration system 10, the controller 50 controls operation of the subcooling compressor 18 to maintain the subcooler evaporating temperature at a point of highest efficiency. In a preferred embodiment, the controller 50 controls running speed of the subcooling compressor 18 to maintain the subcooler evaporating temperature at a desired setpoint, i.e., a value corresponding to a highest efficiency of the refrigeration system 10. The subcooling compressor 18 has variable speed capability and running speed of the subcooling compressor 18 is increased or decreased so that it operates at the highest efficiency subcooler evaporating temperature. In prior art refrigeration systems, the subcooler evaporating temperature is set at a fixed temperature, for example 30° F. However, improved energy efficiency is achieved by varying the subcooler evaporating temperature depending on a primary evaporating temperature and a condensing temperature of the refrigeration system 10.

It should be appreciated that other means, rather than variable speed, for unloading and loading the subcooling compressor 18 may be used to maintain the subcooler evaporating temperature, including, but not limited to, pressure regulating valves or turning the compressor on and off. For example, in a refrigeration system including more than one subcooling compressors, the subcooling compressors may be cycled on and off to match an optimum subcooler evaporating temperature.

In the illustrated embodiment, the controller 50 manages operation of the subcooling compressor 18 based upon a primary evaporating temperature and a condensing temperature of the refrigeration system 10. As shown in FIG. 1, the control system includes the controller 50, a first pressure sensor 78, a second pressure sensor 82, and a third pressure sensor 86. The first pressure sensor 78 is disposed in the evaporator line 54 between the evaporator 46 and the primary compressor 14 for measuring the primary evaporating pressure (i.e., suction pressure) of the refrigeration system 10. The second pressure sensor 82 is disposed in the discharge line 58 between the primary compressor 14 and the condenser 30, but preferably prior to refrigerant from the subcooling compressor 18 entering the discharge line 58, for measuring the condensing pressure (i.e., discharge pressure) of the refrigeration system 10. The third pressure sensor 86 is disposed in the subcooler line 74 between the subcooler 38 and the subcooling compressor 18 for measuring the subcooler evaporating pressure (i.e., intermediate pressure) of the refrigeration system 10. All of the sensors 78, 82, 86 are coupled to the controller 50 for transmitting the measured pressure to the controller 50.

In operation, pressure measurements from the first, second and third pressure sensors 78, 82, 86 are transmitted to the controller 50. The controller 50 stores a plurality of coefficients of performance (COP) for a range of particular operating conditions of the refrigeration system 10, in particular, a primary evaporating temperature and a condensing temperature of the refrigeration system 10. The controller 50 derives the primary evaporating temperature based upon the measured primary evaporating pressure and derives the condensing temperature based upon the measured condensing pressure. It should be readily apparent to one of ordinary skill in the art that each pressure measurement has a corresponding temperature measurement. Based upon the derived primary evaporating temperature and condensing temperature of the refrigeration system 10, the controller calculates a COP relating to highest efficiency operation of the refrigeration system 10 and the subcooling compressor 18.

The COP corresponds to a desired subcooler evaporating temperature, which corresponds to a desired subcooler evaporating pressure. The controller 50 varies operation of the subcooling compressor 18, typically the running speed of the subcooling compressor 18, until the measured subcooler evaporator temperature is substantially equal to the desired subcooler evaporator temperature needed for highest efficiency of the refrigeration system 10. For example, if running speed of the subcooling compressor 18 is increased, the subcooler evaporating temperature will decrease. In an embodiment including more than one primary compressor, if the primary evaporating pressure is too high, an additional primary compressor(s) is turned on until the primary evaporating pressure returns to its desired range.

In another embodiment of the control system described above, the first, second and third pressure sensors 78, 82, 86 are replaced with sensors that measure other operating conditions of the refrigeration system 10. For example, a first sensor measures the primary evaporating temperature of the refrigeration system 10 in the evaporator line 54, a second sensor measures the condensing temperature of the refrigeration system 10 in the liquid refrigerant line 62, and a third sensor measures the subcooler evaporating temperature of the refrigeration system 10 in the subcooler line 74.

Figure 3:
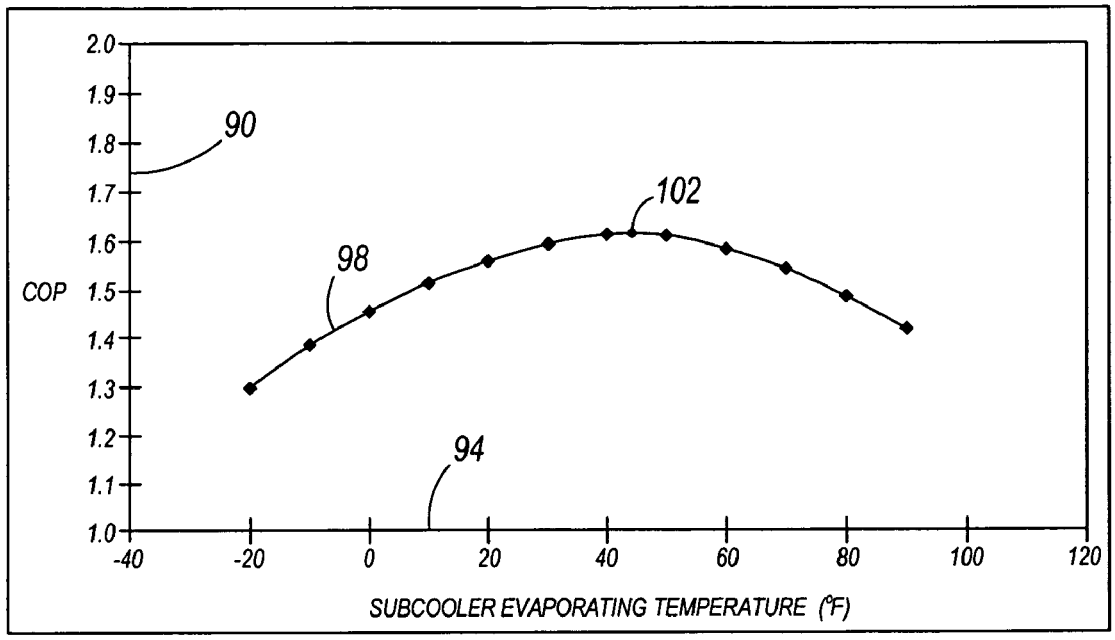
FIG. 3 is a chart showing a coefficient of performance (COP) at various subcooler evaporating temperatures.
Figure 4:
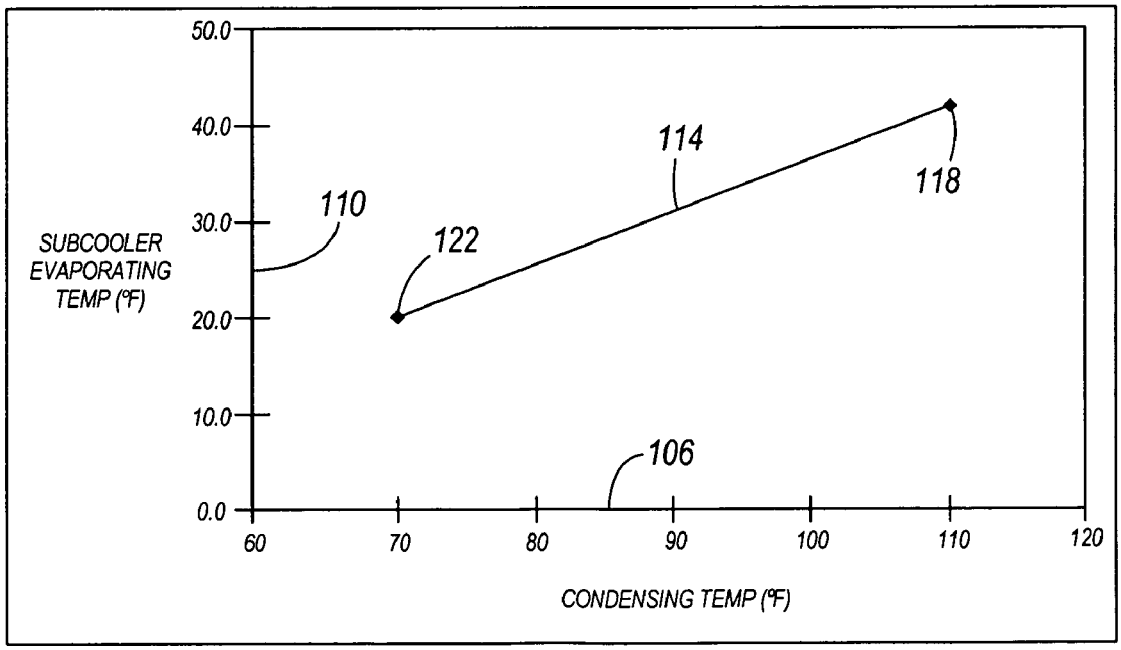
FIG. 4 is a chart showing optimum subcooler evaporating temperature versus condensing temperature at a primary evaporating temperature of −25° F.
Figure 5:
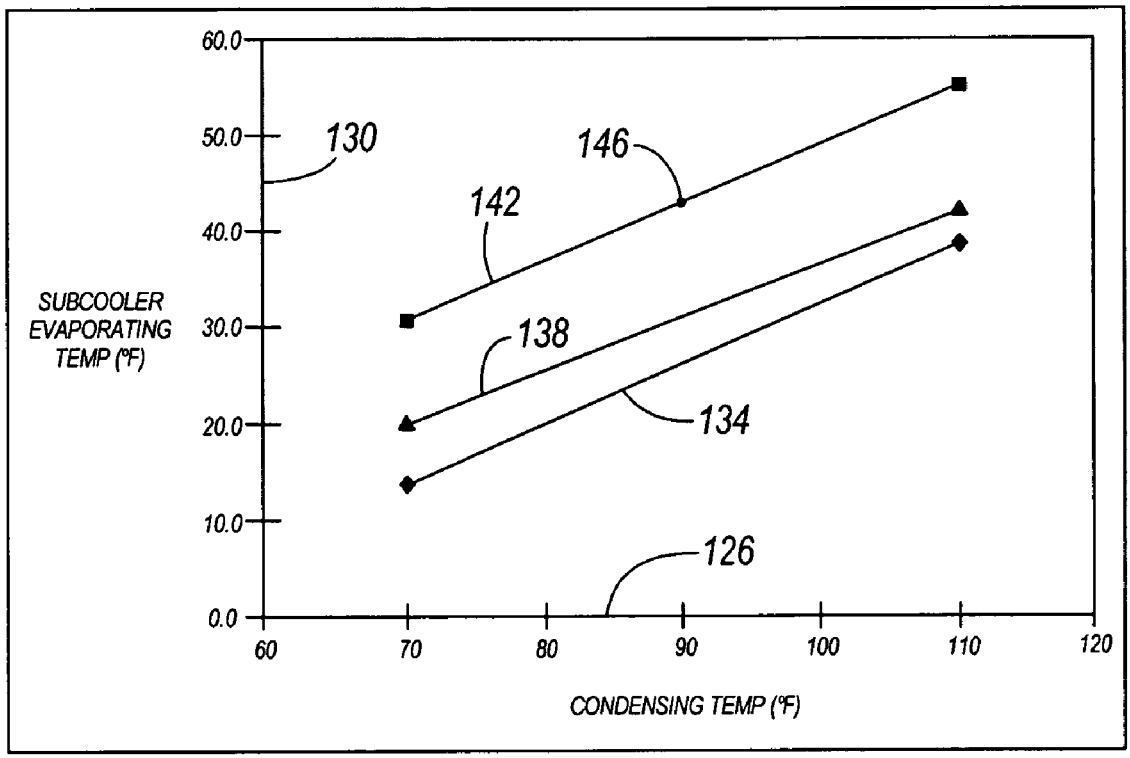
FIG. 5 is a chart showing the optimum subcooler evaporating temperature versus condensing temperature at a variety of primary evaporating temperatures.

FIGS. 3-5 are charts illustrating an example of the methodology used by the controller 50 to determine maximum efficient operation of the refrigeration system 10. The charts illustrated in FIGS. 3-5 reflect use of the R404A refrigerant in the refrigeration system 10. It should be readily apparent that other types of refrigerant may be used in the refrigeration system 10.

FIG. 3 is a chart showing a coefficient of performance (COP) 90 versus subcooler evaporating temperature 94 for the refrigeration system 10. FIG. 3 is directed to specific operating conditions of the refrigeration system 10, −25° F. primary evaporating temperature and 110° F. condensing temperature. COP 90 relative to the operating conditions of the refrigeration system 10 is shown on the Y-axis, and the subcooler evaporating temperature 94 is shown on the X-axis. As shown in FIG. 3, line 98 represents COPs for the specific operating condition of the refrigeration system 10. The highest overall COP of the system is about 1.62 (point 102), which corresponds to a subcooler evaporating temperature of about 42° F. FIG. 3 illustrates that operation of the refrigeration system 10 can be optimized by controlling the subcooler evaporating temperature. As discussed above with respect to the control systems, the refrigeration system 10 controls the subcooler evaporating temperature by adjusting running speed of the subcooling compressor 18.

FIG. 4 is a chart showing the subcooler evaporating temperature required to maximize COP at a primary evaporating temperature of −25° F. and thereby operate the refrigeration system 10 at highest efficiency. Condensing temperature 106 for the refrigeration system 10 is shown on the X-axis, and the subcooler evaporating temperature 110 is shown on the Y-axis. Line 114 corresponds to the primary evaporating temperature at −25° F. and various condensing temperature, and indicates the subcooler evaporating temperature needed for highest overall system efficiency. For example, at −25° F. primary evaporating temperature and 110° F. condensing temperature, the desired subcooler evaporating temperature is about 42° F. (point 118) to obtain the highest overall system efficiency (also shown by FIG. 3). As another example, at −25° F. primary evaporating temperature and 70° F. condensing temperature, the desired subcooler evaporating temperature is about 20° F. (point 122) to obtain the highest overall system efficiency. For any condensing temperature at −25° F. primary evaporating temperature, the highest efficiency subcooler evaporating temperature can be found by selecting the appropriate points on the graph.

FIG. 5 is a chart showing the optimum subcooling evaporating temperature required to maximize COP at other evaporating temperatures. The condensing temperature 126 for the refrigeration system 10 is shown on the X-axis, and the subcooler evaporating temperature 130 is shown on the Y-axis. In FIG. 5, line 134 corresponds to the subcooler evaporating temperature at −40° F. primary evaporating temperature and various condensing temperatures. Line 138 corresponds to the subcooler evaporating temperature at −25° F. primary evaporating temperature and various condensing temperatures (also shown by FIG. 4). Line 142 corresponds to the subcooler evaporating temperature at 0° F. primary evaporating temperature and various condensing temperatures. Accordingly, most efficient subcooler evaporating temperature can be found for many operating conditions by locating the appropriate point in FIG. 5. For example, at 0° F. primary evaporating temperature and 90° F. condensing temperature, the desired subcooler evaporating temperature is about 43° F. (point 146) for highest overall system efficiency of the refrigeration system 10.

The controller 50 determines the maximum efficiency operation of the subcooling compressor 18 and the refrigeration system 10 using the factors and methodology described above with respect to FIGS. 3-5. The controller 50 stores a plurality of COPs for a variety of operating conditions for the refrigeration system 10. Based upon the factors measured by the sensors 78, 82 and received by the controller 50, such as the primary evaporating and condensing temperatures (or pressures), the controller 50 references a highest COP for the corresponding evaporating temperature and condensing temperature. The COP corresponds to a subcooler evaporating temperature for highest efficiency operation of the refrigeration system 10. The controller 50 adjusts running speed of the subcooling compressor 18 to achieve the desired subcooler evaporating temperature.

Various features and advantages of the invention are set forth in the following claims.

What is claimed is:

1. A refrigeration system comprising:

a primary compressor receives refrigerant from an evaporator and delivers refrigerant to a condenser;

a subcooling compressor delivers refrigerant to the condenser;

a subcooler receives refrigerant from the condenser;

a first refrigerant flow path through the subcooler, the first refrigerant flow path delivers a portion of the refrigerant to the evaporator;

a second refrigerant flow path through the subcooler, the second refrigerant flow path delivers a remainder of the refrigerant to the subcooling compressor;

a first sensor for measuring a first operating condition of the refrigeration system corresponding to a primary evaporating temperature;

a second sensor for measuring a second operating condition of the refrigeration system corresponding to a condensing temperature; and a controller operable to control operation of the subcooling compressor, the controller varying operation of the subcooling compressor based upon the first and second operating conditions, the controller calculating a desired subcooler evaporating temperature required for highest efficiency operation of the refrigeration system based upon the primary evaporating temperature and the condensing temperature to maintain the subcooler evaporating temperature such that the refrigeration system operates at a point of highest efficiency.

2. The refrigeration system of claim 1 wherein the primary compressor comprises a plurality of primary compressors, the primary compressors receive refrigerant from the evaporator and deliver refrigerant to the condenser.

3. The refrigeration system of claim 1 wherein the first sensor measures a primary evaporating pressure.

4. The refrigeration system of claim 1 wherein the second sensor measures a condensing pressure.

5. The refrigeration system of claim 1, and further comprising a third sensor for measuring a third operating condition of the refrigeration system corresponding to a subcooler evaporating temperature wherein the controller varies operation of the subcooling compressor to maintain the measured subcooler evaporating temperature at the desired subcooler evaporating temperature.

6. The refrigeration system of claim 5 wherein the third sensor measures a subcooler evaporating pressure.

7. The refrigeration system of claim 1 wherein the controller stores a plurality of coefficients of performance for a range of particular operating conditions of the refrigeration system, each coefficient of performance corresponding to a desired subcooler evaporating temperature, and further wherein the controller determines a highest coefficient of performance from the plurality of coefficients of performance and varies operation of the subcooling compressor to achieve the desired subcooler evaporating temperature.

8. The refrigeration system of claim 1 wherein the controller controls operation of the subcooling compressor by adjusting running speed of the subcooling compressor.

9. The refrigeration system of claim 1 wherein the primary compressor comprises a reciprocating compressor.

10. The refrigeration system of claim 1 wherein the subcooling compressor comprises a reciprocating compressor.

11. A refrigeration system comprising:

a primary compressor receives refrigerant from an evaporator and delivers refrigerant to a condenser;

a subcooling compressor delivers refrigerant to the condenser;

a subcooler receives refrigerant from the condenser, the subcooler includes a first refrigerant flow path that delivers a portion of the refrigerant to the evaporator and a second refrigerant flow path that delivers a remainder of the refrigerant to the subcooling compressor;

a controller operable to control operation of the subcooling compressor;

a first sensor measures a first operating condition of the refrigeration system, the first sensor being coupled to the controller and the first operating condition corresponding to a primary evaporating temperature of the refrigeration system; and a second sensor measures a second operating condition of the refrigeration system, the second sensor being coupled to the controller and the second operating condition corresponding to a condensing temperature of the refrigeration system, wherein based upon the first operating condition measured by the first sensor and the second operating condition measured by the second sensor, the controller controls operation of the subcooling compressor to obtain highest efficiency operation of the refrigeration system.

12. The refrigeration system of claim 11 wherein the primary compressor comprises a plurality of primary compressors, the primary compressors receiving refrigerant from the evaporator and delivering refrigerant to the condenser.

13. The refrigeration system of claim 11 wherein the first sensor measures a primary evaporating pressure.

14. The refrigeration system of claim 11 wherein the second sensor measures a condensing pressure.

15. The refrigeration system of claim 11 wherein the controller calculates an optimum subcooler evaporating temperature for highest efficiency operation of the refrigeration system based upon the primary evaporating temperature and the condensing temperature.

16. The refrigeration system of claim 15 wherein the controller controls operation of the subcooling compressor to maintain the optimum subcooler evaporating temperature.

17. The refrigeration system of claim 15, and further comprising a third sensor that measures a third operating condition of the refrigeration system, the third sensor being coupled to the controller and the third operating condition corresponding to a subcooler evaporating temperature, wherein the controller controls operation of the subcooling compressor to maintain the measured subcooler evaporating temperature substantially equal to the optimum subcooler evaporating temperature.

18. The refrigeration system of claim 15 wherein the controller stores a plurality of coefficients of performance for a range of particular operating conditions of the refrigeration system, each coefficient of performance corresponding to a desired subcooler evaporating temperature, and further wherein the controller determines a highest coefficient of performance from the plurality of coefficients of performance and controls the subcooling compressor to achieve the desired subcooler evaporating temperature.

19. The refrigeration system of claim 11 wherein the controller controls operation of the subcooling compressor by adjusting running speed of the subcooling compressor.

20. The refrigeration system of claim 11 wherein the primary compressor comprises a reciprocating compressor.

21. The refrigeration system of claim 11 wherein the subcooling compressor comprises a reciprocating compressor.

22. A control system for managing operation of a subcooling compressor in a refrigeration system, the control system comprising:

a controller coupled to the subcooling compressor and operable to control operation of the subcooling compressor;

a first sensor measures a first operating condition of the refrigeration system, the first sensor being coupled to the controller and the first operating condition corresponding to a primary evaporating temperature of the refrigeration system;

a second sensor measures a second operating condition of the refrigeration system, the second sensor being coupled to the controller and the second operating condition corresponding to a condensing temperature of the refrigeration system; and wherein based upon the first operating condition measured by the first sensor and the second operating condition measured by the second sensor, the controller controls operation of the subcooling compressor to obtain highest efficiency operation of the refrigeration system.

23. The control system of claim 22 wherein the controller controls operation of the subcooling compressor by adjusting running speed of the subcooling compressor.

24. The control system of claim 22 wherein the first sensor measures a primary evaporating pressure.

25. The control system of claim 22 wherein the second sensor measures a condensing pressure.

26. The control system of claim 22 wherein the controller calculates an optimum subcooler evaporating temperature for highest efficiency operation of the refrigeration system based upon the primary evaporating temperature and the condensing temperature.

27. The control system of claim 26 wherein the controller controls operation of the subcooling compressor to maintain the optimum subcooler evaporating temperature.

28. The control system of claim 26, and further comprising a third sensor that measures a third operating condition of the refrigeration system, the third sensor being coupled to the controller and the third operating condition corresponding to a subcooler evaporating temperature, wherein the controller controls operation of the subcooling compressor to maintain the measured subcooler evaporating temperature substantially equal to the optimum subcooler evaporating temperature.

29. The control system of claim 26 wherein the controller stores a plurality of coefficients of performance for a range of particular operating conditions of the refrigeration system, each coefficient of performance corresponding to a desired subcooler evaporating temperature, and further wherein the controller determines a highest coefficient of performance from the plurality of coefficients of performance and controls the subcooling compressor to achieve the desired subcooler evaporating temperature.

* * * * *

UNITED STATES PATENT AND TRADEMARK OFFICE

CERTIFICATE OF CORRECTION

PATENT NO. : 7,628,027 B2
APPLICATION NO. : 11/184142
DATED : December 8, 2009
INVENTOR(S) : Doron Shapiro It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1176 days.

Signed and Sealed this

Second Day of November, 2010

David J. Kappos

David J. Kappos
*Director of the United States Patent and Trademark Office*